US007018476B2

(12) United States Patent
Kistler et al.

(10) Patent No.: US 7,018,476 B2
(45) Date of Patent: Mar. 28, 2006

(54) DEVICE FOR APPLYING A COATING AGENT

(75) Inventors: Leonhard Kistler, Mering (DE); Robert Vogel, Untermeitingen (DE)

(73) Assignee: AMTEC Kistler GmbH, Prittriching (DE)

( * ) Notice: Subject to any disclaimer, the term of this patent is extended or adjusted under 35 U.S.C. 154(b) by 0 days.

(21) Appl. No.: 10/649,343

(22) Filed: Aug. 27, 2003

(65) Prior Publication Data

US 2004/0163589 A1 Aug. 26, 2004

(30) Foreign Application Priority Data

Aug. 28, 2002 (DE) ..... 102 39 351

(51) Int. Cl.
*B05C 11/10* (2006.01)

(52) U.S. Cl. ..... 118/667; 118/684; 118/687; 118/713

(58) Field of Classification Search ..... 118/712, 118/713, 684, 686, 681, 692, 687, 666, 667; 239/97, 101, 256, 257
See application file for complete search history.

(56) References Cited

U.S. PATENT DOCUMENTS

| | | | | |
|---|---|---|---|---|
| 4,922,852 | A * | 5/1990 | Price | 118/683 |
| 5,755,882 | A * | 5/1998 | Patrick | 118/64 |
| 6,423,366 | B1 * | 7/2002 | Falck et al. | 427/8 |
| 6,436,556 | B1 * | 8/2002 | Bleck et al. | 428/681 |
| 6,517,891 | B1 * | 2/2003 | Estelle et al. | 427/8 |
| 2002/0079325 | A1 * | 6/2002 | Estelle | 222/1 |

* cited by examiner

*Primary Examiner*—George Koch
(74) *Attorney, Agent, or Firm*—Egbert Law Offices

(57) ABSTRACT

A device for applying a coating medium onto a substrate, includes at least one spray valve that has a nozzle opening that can be adjusted with regard to its effective outlet area using a closing mechanism, whereby the substrate can be moved past the spray valve, which can be supplied with the coating medium under pressure via a supply line, whereby the positioning device is assigned a regulator that has at least one target value input for the instantaneously required outflow rate of the coating medium from the spray valve and at least one actual value input for the mass flow rate through a supply section arranged in front of the nozzle opening, and from the deviation between these values, the regulator forms an adjustment signal that moves the positioning device in the direction to offset the deviation.

12 Claims, 3 Drawing Sheets

2
1
10
4
14
11
26
39
40
M
8
4a
29
22
38
22a
27
30
28
3

DEVICE FOR APPLYING A COATING AGENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention involves a device for applying a coating medium onto a substrate, in particular for the application of a lubricant onto a sheet metal that can be fed into a deep drawing press, whereby the device has at least one spray valve that has a nozzle opening that can be adjusted with regard to its effective outlet area using a closing mechanism that can be positioned by an allocated positioning device. The substrate can be moved past the spray valve, which can be supplied with the coating medium under pressure via a supply line.

BACKGROUND OF THE INVENTION

An arrangement of this type is given in the German patent DE 101 39 633.3. The arrangement described in this document functions for the purpose of generating a constant coating thickness of the lubricant onto the sheet metal that is fed into a deep drawing press and accelerated or slowed during the feed operation. A fixed stopper is allocated to the closing mechanism, limiting its opening movement, and is constructed as a rotatable cam, which has a contour that follows the dependence between the speed of the substrate and the outflow rate of the coating medium necessary for a constant coating thickness and/or the position of the closing mechanism allocated for this. The cam is rotatable and is rotated so that its circumferential area assigned to the instantaneous speed of the substrate acts as a stopper. These measures practically produce a fixed value control, in which the position of the closing mechanism is adjusted according to a fixed dependence on the speed of the substrate. As long as no disturbance variables enter into the operation, the desired coating thickness can be achieved in this way. However, disturbance variables such as a contaminant present in the area of the nozzle opening, a change of the viscosity of the coating medium and the like, can lead to inaccuracies. As a result, a lack of lubricant can occur which leads to a damage of the deep draw formed body during the deep draw operation, and thus to the production of rejects. In long-term operation, a frequent preventative maintenance at short maintenance intervals is necessary in order to prevent these types of dangers. An additional disadvantage can be observed in that even during orderly functioning, only the constant coating thickness can be generated. It must, however, be oriented to the maximum requirement that is present at only a few points, thus resulting in an unnecessarily high consumption of coating medium.

Emerging from this is thus the purpose of the present invention, to improve a device according to the type mentioned above using simple and cost-effective mechanisms, so that in spite of a small maintenance expense, a high level of precision is ensured even in long-term operation.

BRIEF SUMMARY OF THE INVENTION

This purpose is achieved according to the invention in that the closing mechanism can be adjusted continuously within a pre-specified adjustment field using the assigned positioning device, whereby the positioning device is assigned a regulator that has at least one target value input for the instantaneously required outflow rate of the coating medium out of the spray valve and at least one actual value input for the mass flow rate in a supply section arranged in front of the nozzle opening. From the deviation, the regulator forms an adjustment signal that moves the positioning device in the direction to offset the deviation.

In an advantageous way, these measures produce a closed regulation circuit in order to regulate the outflow rate which, in connection with the speed of the substrate, produces the desired coating thickness. The control according to the invention advantageously includes all of the parameters affecting the outflow rate. The influence of disturbance variables is thus advantageously eliminated. This enables long maintenance intervals and also ensures a high level of precision in long-term operation. The production of unusable parts following a faulty coating can be prevented to the greatest extent possible in this way. As a result of the continuous adjustability of the closing mechanism, any desired coating thickness and accordingly also a coating profile having a changing thickness over the coating length can be achieved advantageously with a high degree of precision by specification of a corresponding target value. In this way, the consumption of coating medium can be optimized. The advantages that can be obtained by the invention are thus seen especially in its excellent economic viability.

Advantageous embodiments and functional improvements of the independent measures are given in the dependent claims. Thus, the position of the substrate within its path passing the spray nozzle can be functionally detected via a path measurement device, whose output is at the input of a target value control element constructed as a computer in which the desired coating thickness and/or the desired coating thickness profile is saved and which forms the target value for the outflow rate from the instantaneous value of the position of the substrate and the coating thickness allocated to this position. These measures produce a multistage adjustment in which in an advantageous manner via the path measurement, the speed of the substrate is also observed so that a high degree of precision is also achieved for a desired coating thickness profile.

An additional advantageous measure can consist in that the regulator has an additional target value input for the desired temperature of the coating medium and an additional actual value input for the temperature in a supply section arranged before the nozzle opening and from the deviation, forms a control signal for adjusting a heating device allocated to a supply section arranged before the nozzle opening. These measures make it possible in an advantageous way not only to keep a constant temperature, but moreover, they also allow a change of the temperature in addition to the change of the nozzle opening and thus they produce an additional possibility for influencing the outflow rate. This can be advantageous especially if for an adjusted, largest opening, an additional increase in the outflow rate is necessary.

Advantageously, the supply line feeding the spray valve with coating medium can be provided with a Venturi-type diaphragm which has a pressure regulator allocated to it. These measures produce a simple and thus a very precise sensor arrangement to analyze the mass flow in the supply line.

In an additional embodiment of the independent measures, a display and/or recording device can be provided to display and/or record the deviation. This measure enables a simple control and makes easier a subsequent error search.

Functionally, the regulator can be integrated into the allocated spray valve. This produces a simple and compact embodiment in which a peripheral wiring is rendered unnecessary.

An additional advantageous embodiment of the independent measures can consist in that over the width of the substrate, several spray valves are provided, each controllable by a regulator, and that the regulators of all spray valves are connected to a common target value control element in which the coating thickness profiles of the zones of the substrate that are allocated to the spray valves are saved. The common target value control element also forms the target values for all spray valves, whereby between the target value control element and the regulators of the spray valves, a data bus can be advantageously provided. In this way, an especially simple and compact design can be achieved.

Additional advantageous embodiments and functional improvements of the independent measures are given in the remaining dependent claims and the details can be ascertained from the following description of an example using the drawings.

DETAILED DESCRIPTION OF THE INVENTION

The main area of application of the invention presented here is the deep-draw deformation of sheet metals. During deep-drawing, sliding movements occur between tool and workpiece. In order to allow for a clean, disturbance-free sliding, the sheet metals fed to the deep-drawing press are coated with a lubricant, usually oil. This coating is usually done on both sides. Since the sheet metals, however, are not exposed to a sliding movement over their entire surface, a distribution of the lubricant according to the requirements on the surface of the sheet metal to be deformed is desired in order to save lubricant.

Figure 1:
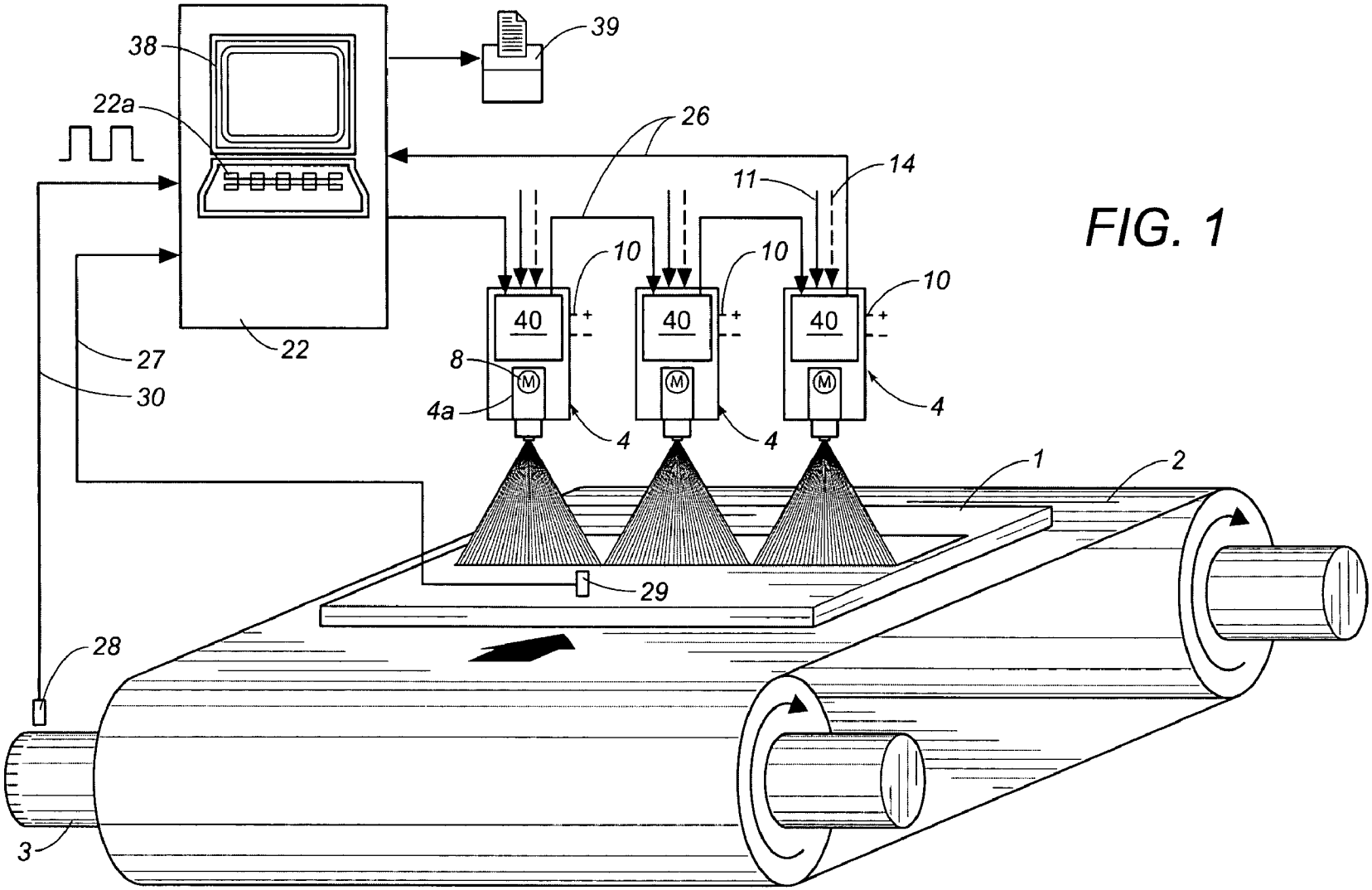
FIG. 1 is a front view of a application device according to the invention in a schematic diagram.

The material to be deformed using the deep-drawing press, i.e. the substrate, is fed to the deep-drawing press either in the form of sheet metal plates or in the form of a continuous band. The arrangement according to FIG. 1 is based on the processing of sheet metal plates 1. They follow each other at uniform distances on a conveyor device 2 (not shown in greater detail) assigned to the deep-drawing press and constructed as a conveyor belt here, which can be driven by a drive device 3. In each cycle of the deep-drawing press, a sheet metal plate 1 is deformed. The sheet metal plates must thus be fed in the cycle of the deep-drawing press. The same applies of course also for a continuous band.

The material that is to undergo the deep-draw operation is usually, as already mentioned, coated on both sides with a lubricant. In order to simplify the drawing, however, only a coating from above is shown in FIG. 1. A similar device can be provided for the coating from below.

The coating device shown contains several spray valves 4 arranged over the width of the substrate that is to be coated, i.e. here the sheet metal 1. They each contain, as is best recognized in FIG. 2, a spraying head 4*a* with a storage chamber 5, in which the lubricant used, oil in the example shown, is under pressure and emerges from the nozzle opening 6 that tapers conically towards its outlet and has an effective opening cross-section that can be changed using an adjustable closing mechanism 7. In order to form the closing mechanism 7, a nozzle needle with a conical tip meshing into the nozzle opening 6 is provided here, which can be moved by a drive device 8, functionally constructed as a linear motor, in the axial direction within its adjustment field that contains all positions between fully closed and fully open. The linear motor can be constructed as a lifting magnet, which is connected via a supply circuit 9 to a current source, in the example shown, the current network 10. Into the storage chamber 5, a supply line 11 opens, over which the lubricant is supplied at the desired pressure into the storage chamber 5. For this purpose, the supply line 11 is connected to a pressure source (not shown in greater detail), for example, an oil pump.

In order to spray the lubricant, spraying air is used in the example shown. For this purpose, an air outlet opening 12 concentrically surrounding the nozzle opening 6 allocated for the lubricant is provided. The air outlet opening emerges from a pressure chamber 13, which is impinged with compressed air via a supply line 14 connected to a compressed air source (not shown in greater detail). In the supply line 14, a stop valve 15 is provided through which the air supply to the pressure chamber 13 and thus to the air outlet opening can be controlled on or off.

In order to manage a precise coating of the sheet metal plates 1 with lubricant which meets the requirements over long-term operation, the outflow rate, i.e. the mass flow rate through the nozzle opening 6 per unit time, which produces the coating thickness together with the speed of the substrate to be coated, is regulated using a regulator device 40 (indicated in FIG. 2 by a dot-and-dash border) containing a closed regulating circuit. In the process, each nozzle opening 6 is assigned a regulator 16 which has a target value input 17 for the instantaneously required outflow rate, i.e. for the lubricant quantity required for the position of the substrate located at that moment under the nozzle opening 6. The regulator also has an actual value input 18 for the mass flow rate through the supply line 11, which corresponds practically to the mass flow rate through the nozzle opening 6. The regulator forms a control signal from the deviation, i.e. from the difference between target value and actual value, through which the valve needle that forms the closing mechanism 7 is adjusted so that the deviation goes away.

For this purpose, the lifting magnet that forms the drive device 8 is impinged with more or less current. To do this, in the supply circuit 9, a choke device 19 is arranged, which is connected via a signal line 20 to the signal output of the assigned regulator 16 and through which, depending on the signal transmitted by the regulator 16, the current impingement of the lifting magnet arrangement that forms the drive device 8 can be increased more or less and/or choked. In order to form the regulator 16, a programmable microprocessor is functionally used. Using the regulator 16, it is also functional to turn the air supply on or off, as is indicated by a signal line 21 leading from the regulator 16 to the stop valve 15. In the process, no regulation takes place, but instead only an on or off control, so that the air impingement begins as soon as the nozzle opening 6 is opened, and vice-versa.

Figure 2:
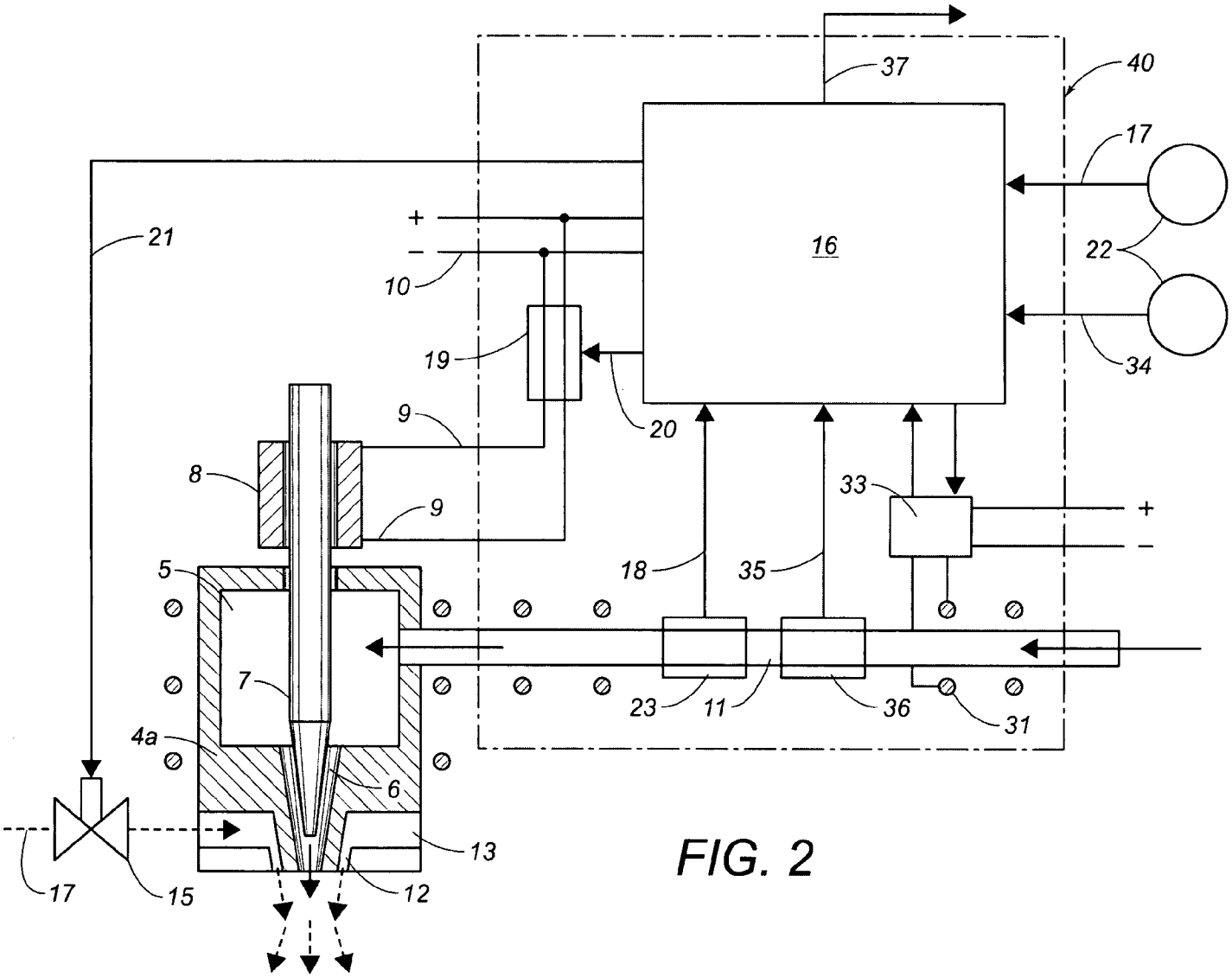
FIG. 2 is a schematic view of a diagram of a spray valve of the arrangement according to FIG. 1.
Figure 3:
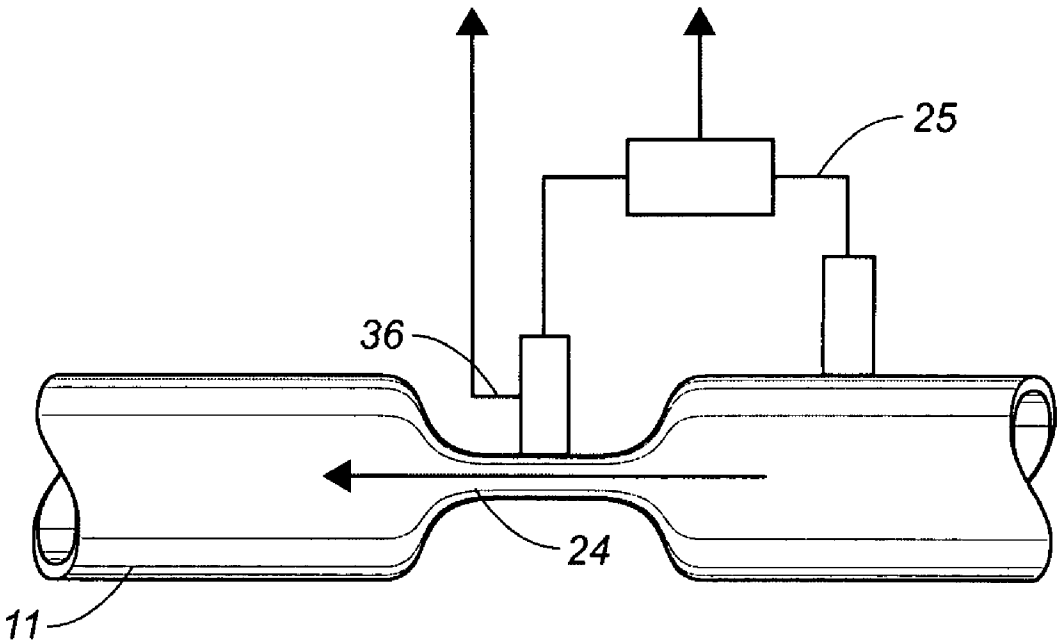
FIG. 3 is a schematic view of a diagram of a flow rate and temperature sensor of the arrangement according to FIG. 1.

The target value for the mass flow rate comes from a suitable target value control element 22 (indicated by a circle in FIG. 2). The actual value is recorded by a measurement sensor 23 (only indicated in FIG. 2). In order to measure the mass flow rate through the supply line 11, it can, as can be recognized in FIG. 3, be provided with a Venturi diaphragm 24, i.e. with a cross-sectional tapering to which a pressure regulator 25 is assigned which delivers an output signal corresponding to the desired actual value of the mass flow rate. With the pressure regulator 25, the pressures in the area of the Venturi diaphragm 24 and in a line section outside of it are measured. The cross-sectional difference between the Venturi diaphragm 24 and the other supply line 11 leads to different speeds in the area of the Venturi nozzle 24 and outside of it. These different speeds lead to different pressures from which thus in connection with the respectively associated cross-section, the speed and thus the mass flow rate can be determined.

It is functional to allocate to the regulators 16 of all spray valves 4 a common target value control element 22, as can be seen in FIG. 1, which is functionally connected via a data bus 26 indicated by signal lines to the regulators 16 of all spray valves 4, which contain an interface suitable for this. The target value control element 22 is functionally constructed as a computer which is provided with a memory register in which the desired coating thickness values in the area of the zones of the substrate allocated to the respective spray valves 4 are saved. This can involve constant values or values of a coating thickness profile. To input these values, the computer that forms the target value control element 22 is provided with a suitable input device 22*a*.

The computer that forms the target value control element 22 is coupled to sensors in order to determine the position of the substrate relative to the spray valves 6. For this purpose, an incremental device 28 acting together with the drive device 3 allocated to the transport device 2 is provided, which generates a signal for each step corresponding to a certain rotational angle and has its output at an input 27 of the target value control element 22. The computer that forms this signal can calculate the transport distance from the number of signals, and it can calculate the speed of sheet metal plates 1 from the number of signals per unit time. The calculation is started using a sensor 29 that detects the front edge of the sheet metal plates 1 and that can be constructed, for example, as a photoelectric barrier, the output of which is connected to a suitable input 30 of the computer that forms the target value control element 22. This computer can calculate accordingly the exact position of the sheet metal plates 1 within their path that passes the spray nozzles 4 and thus calculate the coordinates of each point on the sheet metal plates 1, which is located beneath a spray nozzle 4. From this instantaneous value and the coating thickness allocated to the point involved, the target value for the outflow rate is formed by the target value control element 22.

The spray valves 4 are functionally connected shortly before the opening of the nozzle opening 6. They can also be actuated using the signals generated by the sensor 29. For this purpose, the sensor 29 is arranged simply at a certain dimension in front of the spray nozzles 4, so that they can be first set properly, and then opened at a time delay corresponding to the distance from the sensor 29.

In order to simplify the regulation of the outflow rate and to ensure a high functional safety, the temperature of the lubricant supplied to the spray valves 4 is kept constant at a desired level, resulting in a constant viscosity. For this purpose, a heating device 31, formed by an electrical heating coil, is assigned to the spray heads 4*a* of the spray valves 4 and to the area of the supply line 11 near the spray head. The heating device 31 is connected via a supply circuit 32 to a current source, for example, the installed current network. In the supply circuit 32, a choke device 33 is arranged which can be influenced by the assigned regulator 16. This choke device 33 is provided with a target value input 34 for a temperature target value and an actual value input 35 for the actual value of the temperature of the lubricant supplied to the spray nozzle 4. The actual value of the temperature is recorded using a temperature sensor 36. This temperature sensor can be integrated into the fundamental measurement device for measuring the mass flow rate shown in FIG. 3 in order to obtain a compact arrangement.

Usually it is sufficient if the temperature of the coating medium is kept constant. For this purpose, the regulator 16 is given a constant temperature target value via the input 24. This target value can also be distributed in the common target value control element 22 and output by it and transferred using the data bus 26 for all spray valves 4. However, it is also conceivable to vary the temperature target value using the target value control element 22 in order to hereby additionally vary the outflow rate for the positioning of the valve needle that forms the closing mechanism 7. In any case, the common target value control element 22 requires a memory register for the temperature target values and in case of a variation of these target values, a suitable program for this.

In order to make possible a continuous visual inspection of the coating operation, the actual values present in the area of all spray valves 4 and the associated target values and preferably the regulation deviations formed from them, i.e. the differences between target value and actual value, are displayed. These values are delivered by the regulators 16 of the spray valves 4, as is indicated in FIG. 2 through a data output 37. The display can be done on display devices each allocated to the individual spray valves 4. In the example shown in FIG. 1, the central computer that forms the target value control element 22 is provided with a central display device 38, which can be supplied via the data bus 26 with the values of the individual regulators 16. In order to make easier an error search that might become necessary later, a recording device 3 9, through which the displayed values are continuously recorded, is provided in parallel to the display device 38. It also applies here that each spray valve 4 can be allocated to a separate recording device, in contrast to the example shown in which a common recording device 39 is provided that is assigned to the central computer that forms the target value control element 22. The recording device 39 could, however, also be a part of an additional superordinate process line control.

The regulation device 40 surrounded by a dot-and-dashed line in FIG. 2 is functionally, as shown in FIG. 1, integrated into the assigned spray valve 4. It accordingly contains, in addition to the spray head 4*a* that contains the nozzle opening 6 and the drive device assigned to the nozzle needle, the complete regulation device 40 for regulation of the outflow rate and if necessary, the temperature. The spray valves 4 each form accordingly a complete pre-assembled, connection-ready structural unit which merely must be connected to the supply line 11 for the supply of the coating medium, to the pressure line 14 for the supply of spraying air, to the current source 10 for the current supply, and to the data bus 26 to manage a data flow from and to the central computer that forms the target value control element 22. This also makes the maintenance and service easier, since structural units of this type can be replaced in a completely simple manner.

The invention claimed is:

1. An apparatus for applying a coating medium, the apparatus comprising:

a substrate;

at least one spray valve having a nozzle opening, said nozzle opening having an outlet area, the spray valve having a supply section arranged in front of said nozzle opening;

a closing means cooperative with said nozzle opening for adjusting a size of said outlet area;

a positioning means for positioning said closing means, said substrate being movable with respect to the spray valve;

a supplying means connected by a supply line to the spray valve for supplying the spray valve with the coating medium under pressure, said closing means being continuously adjustable by said positioning means within a desired adjustment field;

a regulator means assigned to said positioning means, said regulator means having at least one target value input for setting an instantaneously required outflow rate of the coating medium from the spray valve, said regulator means for setting at least one input value for a mass flow rate of the coating medium through said supply section, said regulator means for creating an adjustment signal which moves said positioning means relative to a deviation between the target value input and the input value for the mass flow rate, the spray valve having a spraying head, said nozzle opening formed on a conical nozzle, said conical nozzle emerging from a storage chamber connected to said supply line, said closing means being a needle valve cooperative with said nozzle opening, said positioning means for axially moving said needle valve in said nozzle opening, said regulator means for controlling said positioning means, said positioning means being a linear motor with a current supply, said regulator means for regulating said current supply to said linear motor, the target value input being adjustable by said regulator means relative to a desired coating thickness profile over a length of said substrate movable with respect to the spray valve; and a path measurement means for detecting a position of said substrate relative to the spray nozzle, said path measurement means having an output corresponding to said target value input, said regulator means for forming a target value for the outflow rate from an instantaneous value of the position of said substrate and the desired profile coating thickness at the position of said substrate.

2. The apparatus of claim 1, further comprising:

a conveyor means for transporting said substrate by the spray valve, said path measurement means assigned to said conveyor means.

3. The apparatus of claim 2, said path measurement means being actuatable by a movement of said substrate by said conveyor means.

4. The apparatus of claim 1, said regulator means having a first target value input relative to a desired temperature of said coating medium and a second target value input for a temperature of the coating medium in said supply section, said apparatus further comprising:

a heating means for controlling a temperature of the coating medium relative to a deviation between said first target value input and said second target value input.

5. The apparatus of claim 1, further comprising:

a pressurizing means for impinging the spray valve with pressurized air so as to spray the coating medium through the spray valve, said pressurizing means having a pressure line extending to the spray valve; and a valve means connected to said pressure line for controlling a flow of the pressurized air, said regulator means for controlling said valve means.

6. The apparatus of claim 1, further comprising:

a mass flow rate measurement means connected to said spray valve for measuring the mass flow rate of the coating medium through said nozzle opening of said spray valve, said mass flow rate measurement means having a venturi diaphragm therein.

7. The apparatus of claims 6, said mass flow rate measurement means having a temperature sensor means connected thereto, said temperature sensor means for measuring a temperature of the coating medium passing through said venturi diaphragm of said mass flow rate measurement means.

8. The apparatus of claim 1, said linear motor comprising a lifting magnet having a coil, said coil having a current supply connected thereto, said regulator means for controlling the current supply to said coil.

9. The apparatus of claim 1, said regulator means comprising a programmable microprocessor.

10. The apparatus of claim 1, further comprising:

a display means electrically connected to said regulator means, said display means for producing a humanly perceivable display of the deviations in the form of an actual outflow rate of the coating medium, said regulator means being an integrated regulation device contained within the spray valve.

11. The apparatus of claim 1, said at least one spray valve comprising a plurality of spray valves arranged over a width of said substrate, said regulator means comprising a plurality of regulators connected to each of said plurality of spray valves, the apparatus further comprising:

a memory means connected to said regulator means for storing the target value inputs for each of said plurality of spray valves.

12. The apparatus of claim 11, further comprising:

a data bus connected to said plurality of regulators.

* * * * *